United States Patent [19]

Beam

[11] Patent Number: 4,674,565

[45] Date of Patent: Jun. 23, 1987

[54] HEAT PIPE WICK

[75] Inventor: Jerry E. Beam, Dayton, Ohio

[73] Assignee: The United States of America as represented by the Secretary of the Air Force, Washington, D.C.

[21] Appl. No.: 751,399

[22] Filed: Jul. 3, 1985

[51] Int. Cl.[4] ..... F28D 15/00

[52] U.S. Cl. ..... 165/104.26; 29/157.3 H; 165/134.1

[58] Field of Search ..... 165/104.26, 134.1, 32, 165/96; 29/157.3 R, 157.3 H

[56] References Cited

U.S. PATENT DOCUMENTS

| | | | |
|---|---|---|---|
| 3,613,774 | 10/1971 | Bliss, Jr. | 165/32 |
| 3,666,005 | 5/1972 | Moore, Jr. | 165/104.26 |
| 3,754,594 | 8/1973 | Ferrell | 165/32 |
| 3,921,710 | 11/1975 | Katayama | 165/104.26 |
| 3,965,334 | 6/1976 | Asselman et al. | 165/104.26 |
| 4,136,733 | 1/1979 | Asselman et al. | 165/32 |
| 4,170,262 | 10/1979 | Marcus et al. | 165/104.26 |
| 4,489,777 | 12/1984 | Del Bagno et al. | 165/104.26 |

FOREIGN PATENT DOCUMENTS

| | | | |
|---|---|---|---|
| 2430880 | 2/1975 | Fed. Rep. of Germany | 165/104.26 |
| 164283 | 10/1982 | Japan | 165/96 |

OTHER PUBLICATIONS

*Heat Pipe Design Handbook,* B&K Engineering, Inc., NTIS 1979, pp. 63–65, 81, 82–83.

*Heat Pipes,* Dunn., P. & Reay, D. A., Univ. of Reading, England and International Research and Development Col, Ltd., 1976, pp. 209–210, 218–223.

*Heat Pipe Theory and Practice,* Chi, S. W., McGraw-Hill Publishing, Inc., 1976, pp. 11–13, 153–155.

*Primary Examiner*—Albert W. Davis, Jr.

*Attorney, Agent, or Firm*—Fredric L. Sinder; Donald J. Singer

[57] ABSTRACT

A heat pipe with an improved wick design has an unheated section of greater wick wall thickness next to the evaporator section of the heat pipe and on the opposite side of the evaporator section from the condenser section. The greater wick wall thickness acts as a reservoir of liquid heat pipe working fluid to prevent dry out of the wick during pulsed high thermal energy transfer conditions and to eliminate the need to enforce quasi-steady state heat input requirements during start-up operation.

16 Claims, 4 Drawing Figures

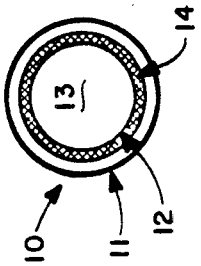
Fig. 1b PRIOR ART
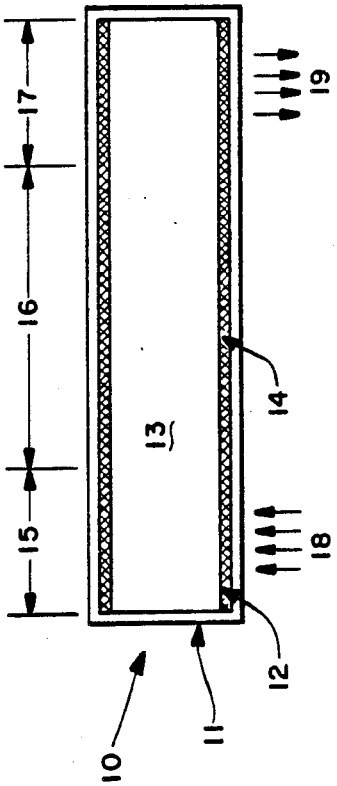
Fig. 1a PRIOR ART
Fig. 2
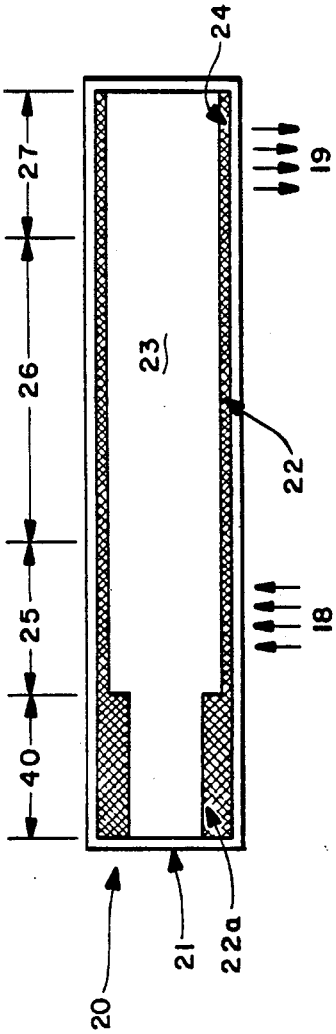

HEAT PIPE WICK

RIGHTS OF THE GOVERNMENT

The invention described herein may be manufactured and used by or for the Government of the United States for all governmental purposes without the payment of any royalty.

BACKGROUND OF THE INVENTION

This invention relates generally to the field of heat pipes, and more particularly to heat pipes suitable for use under conditions of variable and high peak heat loads caused by the use of pulsed high energy sources or other similar equipment.

Heat pipes use successive evaporation and condensation of a working fluid to take advantage of the high heat of vaporization found in most fluids to transfer large amounts of thermal energy over relatively small temperature gradients.

The primary use of heat pipes is in cooling, where the heat pipe is used to transfer thermal energy from a heat source to a heat sink. Such heat pipes are typically of two basic types, selected according to the nature of the heat source from which heat is to be removed. The steady state heat pipe is the simplest and is designed to remove thermal energy from a heat source of relatively constant output. The variable conductance heat pipe is more complicated and is designed to remove thermal energy from a heat source that varies in thermal energy output. In normal use, the thermal conductance of the variable conductance heat pipe is varied to maintain a constant temperature of the heat source.

Variable conductance heat pipes are designed to operate efficiently only over a specific and limited range of thermal energy transfer. They are not suitable for use where the peak thermal energy output load is very much greater than the normal load. This can occur when operating high energy pulsed devices which will dissipate extremely high levels of thermal energy, but only for short periods, yet still require the heat pipe to efficiently remove thermal energy during other phases of operation of the devices which produce a lower thermal energy output.

With the foregoing in mind, it is, therefore, a principal object of the present invention to provide a heat pipe design able to efficiently remove thermal energy during periods of pulsed high thermal energy output, as well as during periods of lower thermal energy output.

It is a further object of the present invention to provide a heat pipe design that allows rapid start-up of the heat pipe.

SUMMARY OF THE INVENTION

In accordance with the foregoing principles and objects of the present invention, a novel heat pipe design and method of manufacturing is described which is particularly suitable to pulsed high thermal energy applications.

The invention provides a reservoir of liquid heat pipe working fluid next to the evaporator section of the heat pipe to prevent dry out of the heat pipe wick during pulsed high thermal energy transfer conditions and during start-up of the heat pipe, and which also provides for efficient operation during lower thermal energy transfer conditions.

The reservoir utilizes a novel wick design which includes an unheated section of greater wick wall thickness next to the evaporator section of the heat pipe and on the opposite side of the evaporator section from the condenser section.

The wick may be formed by rolling a L-shaped sheet of wick material into a hollow cylinder.

BRIEF DESCRIPTION OF THE DRAWINGS

The present invention will be more clearly understood from a reading of the following detailed description in conjunction with the accompanying drawings.

FIG. 1*a* is a representational view in axial section of a prior art steady state heat pipe.

FIG. 1*b* is a view in radial section of the heat pipe of FIG. 1.*a*.

FIG. 2 is a representational view in axial section of a heat pipe according to the present invention.

DETAILED DESCRIPTION OF THE INVENTION

Figure 3:
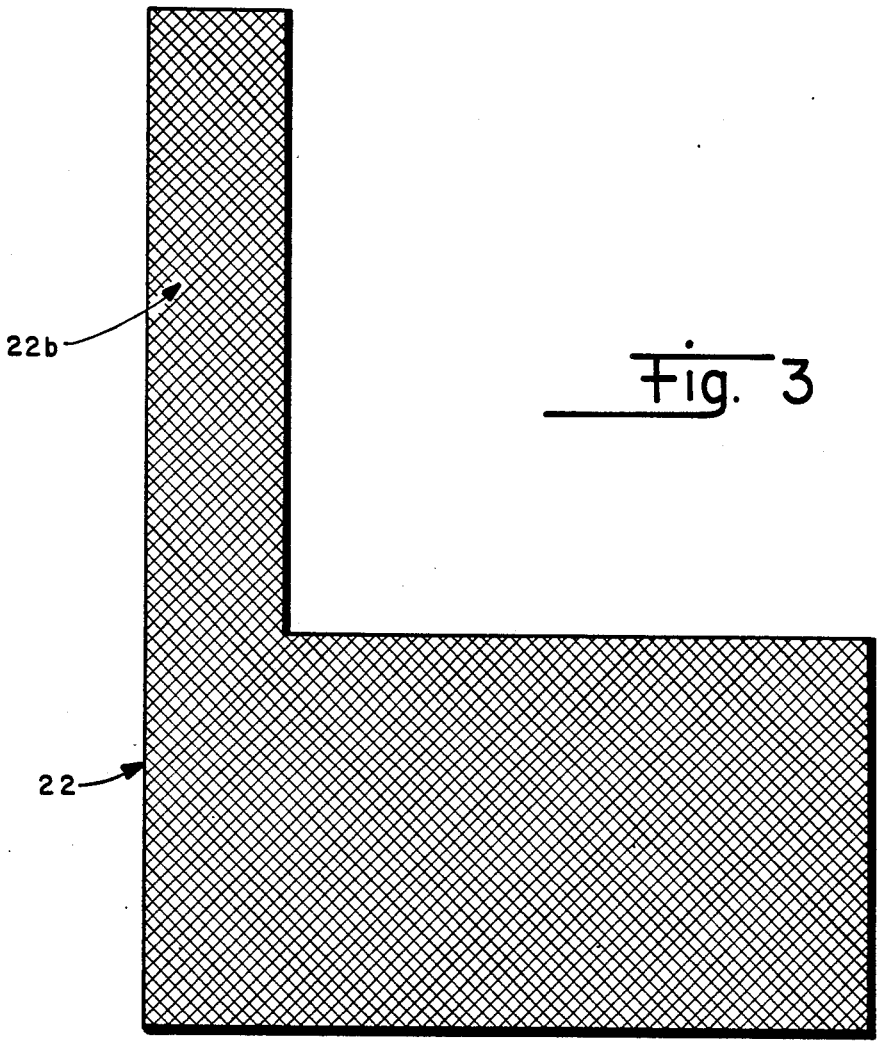
FIG. 3 is a view of the unrolled L-shaped wick material which may be used in one embodiment of the present invention.

Referring now to FIGS. 1.*a*. and 1.*b*. of the drawings, there is shown a prior art steady state heat pipe 10. The relevant features of the heat pipe 10 comprise the sealed cylindrical container 11, the wick 12, and the vapor space 13. Saturated within the wick 12 is the liquid working fluid 14, which may be ammonia, methanol, water, or any of a number of fluids selected for their high heat of vaporization and having an acceptable vaporization temperature in the preselected range within which the heat pipe will operate. The heat pipe 10 typically includes an evaporator section 15, an adiabatic section 16, and a condenser section 17. The adiabatic section is not necessary to the operation of the heat pipe, but is found in nearly all heat pipes.

In operation, the evaporator section 15 of the heat pipe is placed into thermal contact with a heat source 18, and the condenser section 17 is placed into thermal contact with a heat sink 19. As thermal energy from the heat source 18 is supplied to the evaporator section 15, the liquid working fluid 14 impregnating the wick absorbs the thermal energy and begins to vaporize, undergoing a phase change from liquid to vapor. The vapor pressure from vaporization forces the vapor through the vapor space 13 toward the condenser section 17 of the heat pipe. The condenser section 17 being cooler, the vapor condenses back into a liquid, giving up to the heat sink 19 its latent heat of vaporization which was acquired in the evaporator section 15. The liquid is absorbed by the wick 12 in the condenser section 17 and the force of capillary action wicks the liquid back toward the evaporator section 15 where it is once again available for evaporation. The process will rapidly reach equilibrium and operate continuously as long as heat is supplied.

Since the heat of vaporization for most fluids is so large, the standard heat pipe will transfer a very large amount of thermal energy in comparison to a simple mass conduction device. Since the vaporization temperature of the working fluids may be controlled by the vapor pressure inside the pipe, heat pipes may be designed to work over specific and very small temperature gradients.

The standard steady state heat pipe 10 just described may be modified in many standard ways known to the art. For example, the wicking effect used to return the condensed liquid working fluid from the condenser 17 to the evaporator 15 may be augmented by gravity by placing the container 11 in an upright position. Axial grooves along the inner diameter of the container 11 are also sometimes used to increase fluid flow. Rather than a simple cylindrical container, the heat pipe may be enclosed by square or tubing of variable cross-sectional shape; it may be bent at various angles to fit various applications. The wick material used may vary in composition along its length. For example, the wick material may vary in porosity and thickness along its length, or even be made up of different materials butted together. By adding a controllable pressure source of a non-condensable vapor such as nitrogen to the area adjacent to the condenser section, non-condensable vapor may be pumped in to displace the working fluid vapor over a variable length of the condenser section. This effectively shortens the length of the condenser section and reduces the total thermal conductivity of the heat pipe. This is the basis of the standard variable conductance heat pipe.

Another aspect of heat pipe design known to the art is the wall thickness of the wick. A very thin-walled wick is generally used to minimize the temperature drop in the evaporator region and to assure that the heat transfer process will occur at the liquid/vapor interface. The problem is that only a very little liquid working fluid inventory is available in a thin-walled wick and in the event a very high pulse of thermal energy is suddenly delivered to the evaporator region, the available liquid working fluid may evaporate faster than the condensed fluid from the condenser region is being returned to reprime the evaporator wick section and the wick will dry out, stopping heat transfer. Standard heat pipes with thin-walled evaporator wicks also require a slow, or quasi-steady state, start-up cycle to avoid wick dry out. The problem of wick dry out will also occur in a variable conductance heat pipe which typically controls only the length of the condenser region and not the rate at which the condensed liquid working fluid is returned to the evaporator section.

FIG. 2 shows the improved heat pipe 20 incorporating the present invention. The improved heat pipe 20 comprises a sealed cylindrical container 21, a wick 22, and a vapor space 23. Saturated within the wick 22 is a liquid working fluid 24. Heat pipe 20 includes an evaporator section 25, an adiabatic section 26, a condenser section 27, and an unheated additional liquid working fluid storage section 40. Liquid working fluid storage section 40 encloses a section **22*a* of greater wick wall thickness adjacent to the evaporator section 25 and on the other side of the evaporator section 25 from the condenser section 27**.

When a sudden pulse of intense thermal energy is delivered from the heat source 18 to the evaporator section 25 of the improved heat pipe 20, the evaporator section wick is now not only being reprimed from the return of condensed liquid working fluid from the condenser section 27, but also from the liquid working fluid stored in the liquid fluid storage section **22*a*. This source of additional liquid working fluid prevents dry out of the wick and allows the improved heat pipe 20** to operate properly under conditions of extended pulsed high energy heat transfer. The additional fluid source also allows the improved heat pipe to operate without the need to enforce quasi-steady state, or slowly increasing, thermal energy start-up requirements as in the standard heat pipe.

Referring now to FIG. 3, there is shown a wick 22 used in the construction of a heat pipe 20 built in demonstration of the invention herein. Wick 22 comprises an "L" shaped sheet of wick material which may be suitably rolled into a hollow cylinder for insertion into the heat pipe 20. The wick 22 of the demonstration heat pipe 20 was made of 100×100 mesh copper screen cut in an "L" pattern comprising a rectangular piece of width 18 inches and height $9\frac{3}{8}$ inches, and a tab piece **22*b* of width 3 inches and height 15 inches. The combined height of the rectangular and tab pieces of the wick was $24\frac{3}{8}$ inches. The wick was rolled on a mandrel with an end section of reduced diameter corresponding to the thicker section 22*a* of wick 22. The tab was rolled on the reduced diameter end section of the mandrel to provide a hollow cylindrical wick of constant outer diameter and reduced inner diameter where the additional windings of the tab piece 22*b*** reside.

It is understood that certain modifications to the invention as described may be made, as might occur to one with skill in the field of this invention, within the scope of the claims. Therefore, all embodiments contemplated have not been shown in complete detail, and other embodiments may be developed without departing from the spirit of this invention or from the scope of the appended claims.

I claim:

1. A heat pipe system for conducting thermal energy, comprising:

(a) a heat source;

(b) a heat sink;

(c) a hermetically sealed tubular container;

(d) the interior of the container having along its length, in order, an unheated first section, an evaporator section thermally coupled to the heat source, and a condenser section thermally coupled to the heat sink;

(e) wick material defining a hollow tube wick disposed inside the length of the tubular container;

(f) a liquid working fluid impregnating the wick material; and (g) the wick material in the unheated first section being continuous with the wick material in the evaporator section.

2. The heat pipe system as described in claim 1, wherein the wall thickness of the hollow tube wick in the unheated first section is greater than in the evaporator section.

3. The heat pipe system as described in claim 2, wherein the wick is a L-shaped sheet of wick material rolled into a hollow tube.

4. The heat pipe system as described in claim 1, wherein the hermetically sealed tubular container includes an adiabatic section between the evaporator section and the condenser section.

5. The heat pipe system as described in claim 3, wherein the wick material is 100×100 mesh copper screen.

6. A method of manufacturing a heat pipe, comprising:

(a) providing a tubular container;

(b) providing an L-shaped sheet of wick material;

(c) rolling the L-shaped sheet of wick material into a hollow tube to form a wick;

(d) placing the wick inside the tubular container;

(e) impregnating the wick with a liquid working fluid; and, (f) hermetically sealing the wick within the tubular container.

7. A heat pipe system for conducting thermal energy, comprising:

(a) a heat source;

(b) a heat sink;

(c) a container;

(d) the interior of the container having, in order, an unheated first section, an evaporator section thermally coupled to the heat source, and a condenser section thermally coupled to the heat sink;

(e) wick material disposed inside the container;

(f) a liquid working fluid impregnating the wick material; and, (g) the wick material in the unheated first section being continuous with the wick material in the evaporator section.

8. The heat pipe according to claim 7, wherein the thickness of the wick in the unheated first section is greater than in the evaporator section.

9. The heat pipe according to claim 8, wherein the wick is a sheet of wick material shaped so that, when positioned inside the container, the material overlaps in the unheated first section.

10. The heat pipe according to claim 7, wherein the container includes an adiabatic section between the the evaporator section and the condenser section.

11. The heat pipe according to claim 9, wherein the wick material is 100×100 mesh copper screen.

12. A method of conducting thermal energy from a heat source to a heat sink, comprising the steps of:

(a) providing a heat pipe having:

(i) along its length, in order, a unheated first section, an evaporator section, and a condenser section;

(ii) wick material defining a hollow tube wick disposed along the length of the interior of said heat pipe, the wick material in the first section being continuous with the wick material in the evaporator section; and, (iii) liquid working fluid impregnating the wick material;

(b) thermally coupling the heat source to the evaporator section; and, (c) thermally coupling the heat sink to the condenser section.

13. The method of conducting thermal energy according to claim 12, wherein the wall thickness of the hollow tube wick in the first section is greater than in the evaporator section.

14. The method of conducting thermal energy according to claim 13, wherein the wick is a L-shaped sheet of wick material rolled into a hollow tube.

15. The method of conducting thermal energy according to claim 12, wherein the heat pipe includes an adiabatic section between the evaporator section and the condenser section.

16. The method of conducting thermal energy according to claim 14, wherein the wick material is 100×100 mesh copper screen.

* * * * *